US008634762B2

(12) United States Patent
Keane

(10) Patent No.: US 8,634,762 B2
(45) Date of Patent: Jan. 21, 2014

(54) MOBILE COMMUNICATION DEVICES WITH AN ANALOG FREQUENCY MODULATION (FM) RECEIVER AND RECORDING CAPABILITY

(75) Inventor: James Abraham Keane, Wauconda, IL (US)

(73) Assignee: BlackBerry Limited, Waterloo (CA)

( * ) Notice: Subject to any disclaimer, the term of this patent is extended or adjusted under 35 U.S.C. 154(b) by 0 days.

(21) Appl. No.: 13/416,471

(22) Filed: Mar. 9, 2012

(65) Prior Publication Data

US 2013/0237172 A1 Sep. 12, 2013

(51) Int. Cl.
*H04H 60/09* (2008.01)

(52) U.S. Cl.
USPC ..... 455/3.04; 455/186.1

(58) Field of Classification Search
USPC ..... 455/3.04, 3.01, 186.1, 161.1, 166.2, 455/185.1, 185.6, 344
See application file for complete search history.

(56) References Cited

U.S. PATENT DOCUMENTS

| | | | | |
|---|---|---|---|---|
| 6,088,455 | A * | 7/2000 | Logan et al. | 380/200 |
| 6,112,064 | A * | 8/2000 | Arrowsmith et al. | 455/186.1 |
| 6,131,042 | A | 10/2000 | Lee et al. | |
| 6,510,325 | B1 | 1/2003 | Mack, II et al. | |
| 6,628,928 | B1 | 9/2003 | Crosby et al. | |
| 6,766,523 | B2 * | 7/2004 | Herley | 725/19 |
| 7,076,202 | B1 | 7/2006 | Billmaier | |
| 7,211,958 | B2 | 5/2007 | Maurer et | |
| 7,340,249 | B2 | 3/2008 | Moran et al. | |
| 7,366,461 | B1 | 4/2008 | Brown | |
| 7,369,870 | B2 | 5/2008 | Sakoda et al. | |
| 7,580,671 | B2 * | 8/2009 | Felder | 455/3.04 |
| 8,331,966 | B2 * | 12/2012 | Anzures et al. | 455/503 |
| 2002/0049037 | A1 | 4/2002 | Christensen et al. | |
| 2004/0117442 | A1 | 6/2004 | Thielen | |
| 2006/0004640 | A1 | 1/2006 | Swierczek | |
| 2006/0074808 | A1 | 4/2006 | Boesen | |
| 2007/0259650 | A1 | 11/2007 | Felder | |
| 2010/0057590 | A1 | 3/2010 | Wesby | |

FOREIGN PATENT DOCUMENTS

| | | | |
|---|---|---|---|
| JP | 2002157865 | A | 5/2002 |
| WO | 20060127042 | A1 | 11/2006 |

OTHER PUBLICATIONS

Extended European Search report mailed Apr. 24, 2012. In corresponding application No. 12159538.3.
Andrew Kameka, TuneIn Radio Pro records live radio stream on Android [Video App Reviews].http://androinica.com/2011/04/tunein-pro-record-android-stream/, Apr. 27, 2011.

(Continued)

*Primary Examiner* — Sonny Trinh
(74) *Attorney, Agent, or Firm* — Novak Druce Connolly Bove + Quigg LLP

(57) ABSTRACT

Methods and devices are provided for recording radio broadcasts received in an analog format at a mobile communication device. The mobile communication device receives analog radio broadcast signals and analog radio data system information signals corresponding to the analog radio broadcast signals. A radio application extracts radio data system information in response to users selecting a record operation, creates a file name from the extracted radio data system information, and stores radio content corresponding to the extracted radio data system information in response to the user selecting the record operation. The radio application further monitors the radio data system information for pre-defined criteria and sends alerts to the user upon detecting the pre-defined criteria. In response to selecting the record operation, the radio application further enables users to rewind the stored radio content by a pre-determined amount and append buffered radio content to a beginning of the stored radio content.

20 Claims, 4 Drawing Sheets

(56) References Cited

OTHER PUBLICATIONS

Synsion Radio Technologies, TuneIn Radio Pro, http://itunes.apple.com/au/app/tunein-radio/id319295332?mt=8, 2010 and retrieved on Sep. 8, 2011.
How to Record FM Radio Broadcast Straight From Your Phone?, http://www.rushlywritten.com/2010/11/how-to-record-fm-radio-broadcast.html. Retrieved on Mar. 9, 2012.
Samsung, "How to record songs from the FMradio on the Samsung Monte". http://www.knowyourmobile.com/...msungjetultra/jetultrauserguides/570349/how__to__record__songs__from__the__fm__radio__on__the__samsung__monte.html. Published Aug. 20, 2010.
Nokia, Nokia Australia—Nokia 2323 classic—Specifications. http://www.nokia.com.au/find-products/all-phones/nokia-2323-classic/specifications. Published In 2011 and retrieved on Sep. 8, 2011.
Allen Tsai, Sony Ericsson R300 and R306 Combines AM/FM Radio Experience, http://www.mobiledia.com/news164721.html, Jan. 28, 2008.
Samsung, "Using the FM radio on the SamsungG600", http://www.knowyourmobile.com/samsung/samsungg600/g600userguides/5877/using__the__fm__radio__on__the__samsung__g600.html. Published on Oct. 30, 2007.
Ian Gizmo Richards, Record FM radio music to MP3, http://windowssecrets.com/support-alert/record-fm-radio-music-to-mp3/, Jan. 18, 2006.

* cited by examiner

MOBILE COMMUNICATION DEVICES WITH AN ANALOG FREQUENCY MODULATION (FM) RECEIVER AND RECORDING CAPABILITY

FIELD OF THE DISCLOSURE

This disclosure relates generally to mobile communication devices, and more particularly, to mobile communication devices that include analog frequency modulation (FM) receivers for receiving audio transmissions along with radio data system (RDS) information or radio broadcast data system (RBDS) information.

BACKGROUND

Analog or over-the-air FM radio stations utilize the Ultra-High Frequency (UHF) band (87.5 to 108.0 MHz) to broadcast multiple radio channels that are 200 KHz apart. Analog FM radio stations use, for example, Frequency Division Multiple Access (FDMA) to share the UHF band such that the stereo broadcast for each channel occupies 53 KHz of 75 KHz available on each side of the channel center frequency. The frequency region between 53 KHz and 75 KHz is set aside for sideband applications, such as RDS information or virtually identical RBDS information. For example, RDS may use the 55 KHz to 59 KHz region. RDS uses Phase Shift Keying (PSK) at a physical-layer data rate of 1187.5 bps. RDS may use error detection and correction, which reduces the effective date rate.

Existing mobile communication devices include hardware that receives analog radio waves along with RDS information provided alongside each broadcast channel. The RDS information includes metadata associated with the radio program, such as station and program name. RDS data fields may include a 16 bit Program ID (PI) that is uniquely assigned to each radio station; an 8 character Program Service (PS); a 64 character Radio Text (RT); a 5 bit Program Type (PTY); and a custom data field. Alternatively, existing mobile communication devices with a subscription based data plan may receive digital radio transmissions through Internet radio. What is needed is an application for a mobile communication device that records a radio broadcast received in an analog format at a mobile communication device and extracts radio data system information corresponding to the radio broadcast to provide a name for the recording.

DETAILED DESCRIPTION

Figure 1:
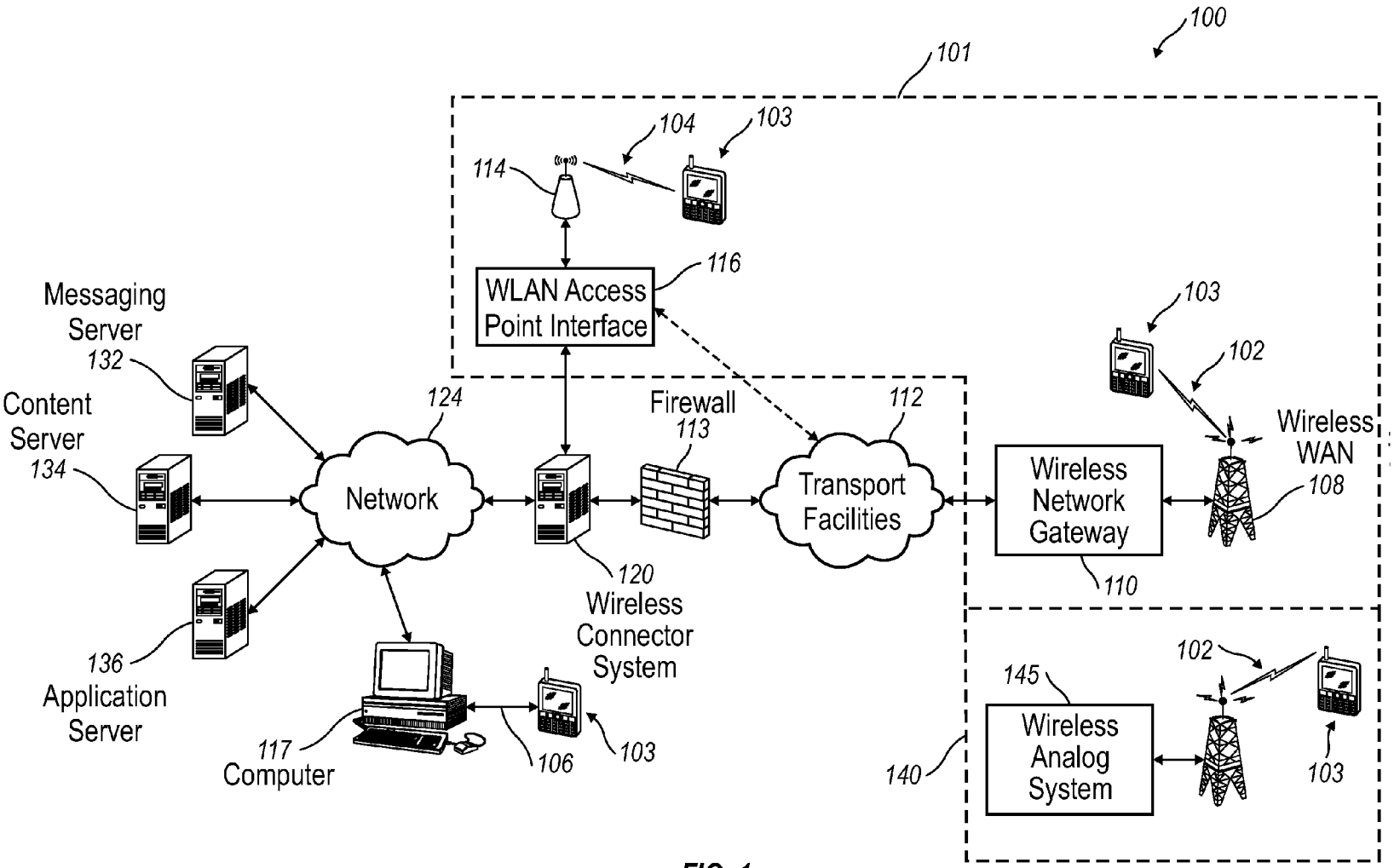
FIG. 1 is a communication system for mobile communication devices according to one example.

This disclosure provides a software application (hereinafter a "radio application") having a graphical user interface (GUI) that enables users to select among various analog or over-the-air radio stations. The radio application also enables users to perform actions on the radio station content, including recording content, naming a file that corresponds to recorded radio content, sharing information associated with the radio content, and purchasing items advertised through the radio content, or the like.

The radio application further allows users to efficiently store, locate, and retrieve radio content from the mobile communication device. For example, the radio application may be configured to generate a file name for the recorded content, where the file name may be generated from at least device information and RDS data that accompanies the radio broadcast. Once stored, the radio application enables users to efficiently retrieve desired radio content. Additionally, the radio application may be configured to communicate in substantially real-time with social media applications including BLACKBERRY® Messenger and FACEBOOK™, or the like, to share information associated with the radio content.

While listening to analog radio broadcasts on the mobile communication device, users may select a record icon or button to begin recording desired radio content. For example, users may select the record icon by manipulating an input device, such as a keyboard, a navigation tool, a touch-sensitive screen or a voice-command receiving tool, or the like. The recording operation may initiate a process that includes accessing a memory buffer, which continuously stores radio content. The memory buffer may be configured to store a pre-determined length of radio content, such as 10 seconds, and the memory buffer may be continuously overwritten to maintain a pre-determined amount of currently received radio content. One of ordinary skill in the art will appreciate that the memory buffer may be configured to store a pre-determined amount of radio content that is greater than or less than 10 seconds. Alternatively, the user may select the recording length to the memory buffer.

According to one example, upon initiating the recording operation, the radio application continues recording the desired radio content to the memory buffer so that the desired radio content follows the pre-determined length of pre-recorded radio content. In this way, the pre-determined length of pre-recorded radio content compensates for user delay or latency in recognizing the desired radio content and selecting the record icon. The user may adjust the length of pre-recorded radio content which is added to the beginning of the user-initiated recording operation. For example, the user may elect to have all, none or some of the pre-determined length of pre-recorded radio content added to the beginning of the recording operation. Alternatively or additionally, the radio application may be configured to allow users to rewind or replay the pre-determined amount of the over-the-air content to capture missed information, such as a telephone number, address, or other missed information.

The radio application may be configured to monitor RDS data corresponding to received over-the-air content and automatically perform preselected actions. For example, the radio application may automatically prepare and send alerts using communication applications, such as instant message applications or email applications, when the RDS data includes preselected titles, artists, songs or the like. Furthermore, the radio application may automatically record over-the-air radio content when the RDS data includes preselected titles, artists, songs or the like. Alternatively, the radio application may prompt users to record over-the-air radio content by actuating an input device, such as selecting one or more keys on keyboard of the mobile communication device. The radio application may be configured to perform other preselected actions.

FIG. 1 illustrates an example of an operating environment for a communication system 100 that may include a number of mobile communication devices 103. The communication system 100 supports the mobile communication devices 103 in any of several different ways. The mobile communication devices 103 may be communicatively coupled to wireless digital networks 101, such as one or more of a Wireless Wide Area Network (WWAN) 102 and a Wireless Local Area Network (WLAN) 104, among other suitable network arrangements. In some examples, the mobile communication devices 103 may be configured to communicate over the WWAN 102, the WLAN 104, or to roam between these networks. In some examples, the wireless digital networks 101 may comprise multiple WWANs 102 and WLANs 104, among other configurations.

The WWAN 102 may be implemented as any suitable wireless access network technology. By way of example, but not limitation, the WWAN 102 may be implemented as a wireless digital network that includes a number of transceiver base stations 108 (one of which is shown in FIG. 1), where each of the base stations 108 provide wireless Radio Frequency (RF) coverage to a corresponding area or cell. The WWAN 102 typically is operated by a mobile network service provider that provides subscription packages to users of the mobile communication devices 103.

In some examples, the WWAN 102 may conform to one or more of the following wireless network types: LTE (Long Term Evolution); Mobitex Radio Network; DataTAC; GSM (Global System for Mobile Communication); GPRS (General Packet Radio System); TDMA (Time Division Multiple Access); CDMA (Code Division Multiple Access); CDPD (Cellular Digital Packet Data); iDEN (integrated Digital Enhanced Network); Ev-DO (Evolution-Data Optimized); CDMA2000; EDGE (Enhanced Data rates for GSM Evolution); UMTS (Universal Mobile Telecommunication Systems); HSPDA (High-Speed Downlink Packet Access); IEEE 802.16e (also referred to as Worldwide Interoperability for Microwave Access or "WiMAX"), or various other networks. While WWAN 102 is described herein as a "Wide-Area" network, that term is intended also to incorporate wireless Metropolitan Area Networks (WMAN) or other similar technologies for providing coordinated service wirelessly over an area larger than that covered by typical WLANs.

The WWAN 102 may communicate with a wireless network gateway 110 that couples the mobile communication devices 103 to transport facilities 112. The transport facilities 112 couple the mobile communication devices 103 to a wireless connector system 120. The transport facilities 112 may include one or more private networks or lines, the Internet, a virtual private network, or any other suitable network, among other transport facilities. The wireless connector system 120 may be operated, for example, by an organization or enterprise such as a corporation, university, or governmental department, among other organizations or enterprises, which allow access to a network 124, such as an internal or enterprise network (e.g., an intranet) and its resources. Alternatively, the wireless connector system 120 may be operated by a mobile network provider. In some examples, the network 124 may be realized using the Internet rather than, or in addition to, an internal or enterprise network.

The wireless network gateway 110 provides an interface between the wireless connector system 120 and the WWAN 102. The wireless network gateway 110 facilitates communication between the mobile communication devices 103 and other devices (not shown) that may be connected, directly or indirectly, to the WWAN 102. Accordingly, communications sent via the mobile communication devices 103 are transported via the WWAN 102, the wireless network gateway 110 and the transport facilities 112 to the wireless connector system 120. Communications sent from the wireless connector system 120 are received by the wireless network gateway 110 and transported via the WWAN 102 to the mobile communication devices 103.

According to one example, the WLAN 104 includes a wireless digital network that conforms to IEEE 802.11x standards (sometimes referred to as Wi-Fi™) such as, for example, the IEEE 802.11a, 802.11b and/or 802.11g standard. One of ordinary skill in the art will readily appreciate that other communication protocols may be used for the WLAN 104, such as, IEEE 802.11n, IEEE 802.16e (also referred to as Worldwide Interoperability for Microwave Access or "WiMAX"), or IEEE 802.20 (also referred to as Mobile Wireless Broadband Access), among other communication protocols. The WLAN 104 includes one or more wireless RF Access Points (AP) 114 (one of which is shown in FIG. 1) that collectively provide a WLAN coverage area.

The WLAN 104 may be a user's personal network, an enterprise network, or a hotspot offered by an Internet service provider (ISP), a mobile network provider, or a property owner in a public or semi-public area, for example. The access points 114 may be connected to an access point (AP) interface 116 that may connect to the wireless connector system 120 directly or indirectly. A direct connection may be provided when the access point 114 is part of an enterprise WLAN 104 in which the wireless connector system 120 resides. An indirect connection may be provided via the transport facilities 112, as indicated by the dashed signal line in FIG. 1, if the access point 114 is a personal Wi-Fi network or Wi-Fi hotspot. In this case, a mechanism, such as a virtual private network (VPN), may be used for securely connecting to the wireless connector system 120. The AP interface 116 may provide translation and routing services between the access points 114 and the wireless connector system 120 to facilitate communication, directly or indirectly, with the wireless connector system 120.

The wireless connector system 120 may be implemented as one or more servers, and is typically located behind a firewall 113. The wireless connector system 120 manages communications, including email, Hypertext Transfer Protocol (HTTP), and HTTP Secure (HTTPS) communications to and from a set of managed mobile communication devices 103. The wireless connector system 120 also provides administrative control and management capabilities over users and mobile communication devices 103 that may connect to the wireless connector system 120.

The mobile communication devices 103 also may be communicatively coupled to wireless over-the-air networks 140, such as an analog system, a Frequency Modulation (FM) broadcast system 145 or an Amplitude Modulation (AM) system, among other suitable analog network arrangements. A mobile communication device 103 may receive over-the-air broadcasts from the analog FM broadcast system 145 which covers a local geographic region, without requiring a subscription-based data plan or a password protected data transmission schemes. The analog FM broadcast system 145 provides a relatively large coverage, low data rates, low power consumption, and low component costs as compared to wireless digital networks 101.

The wireless connector system 120 allows the mobile communication devices 103 to access the network 124 and connected resources and services, such as a messaging server 132; a content server 134 that provides content, such as Internet content or content from an organization's internal servers; application servers 136 that implement server-based applications, and intranet file services; among other connected resources and services. The application servers 136 communicate with applications on the mobile communication devices 103, including the radio application that captures and stores FM signals from analog FM transmissions.

The network 124 may comprise a private local area network (LAN), metropolitan area network (MAN), wide area network (WAN), the public Internet or combinations thereof. The network 124 may include virtual networks constructed using any of these networks, alone or in combination. Alternatively, the mobile communication device 103 may connect to the wireless connector system 120 using a computer 117, such as a desktop or a notebook computer, via the network 124. A link 106 may be provided between the mobile communication device 103 and the computer 117 for exchanging information between the mobile communication device 103 and a computer 117 connected to the wireless connector system 120. The link 106 may include one or both of a physical interface or a short-range wireless communication interface.

The physical interface may comprise one or a combination of an Ethernet connection, a Universal Serial Bus (USB) connection, a Firewire™ (also known as an IEEE 1394 interface) connection, or other serial data connections, via respective ports or interfaces of the mobile communication device 103 and the computer 117. The short-range wireless communication interface may be a personal area network (PAN) interface. A PAN is a wireless point-to-point connection implemented without physical cables to connect the two end points. The short-range wireless communication interface may include one or a combination of an infrared (IR) connection, such as an Infrared Data Association (IrDA) connection, a short-range radio frequency (RF) connection, such as one specified by IEEE 802.15.1 or the BLUETOOTH special interest group, or IEEE 802.15.3a, also referred to as Ultra-Wideband (UWB), or other PAN connection.

The wireless network gateway 110 is configured to send data packets received at the mobile communication device 103 over the WWAN 102 to the wireless connector system 120. The wireless connector system 120 then sends the data packets to the appropriate connection point such as a messaging server 132 or a content server 134 or an application server 136, or a combination of these. Conversely, the wireless connector system 120 may send data packets received from the messaging server 132, the content servers 134, the application servers 136 or any combination of these, to the wireless network gateway 110 for transmission to a selected mobile communication device 103. The WLAN AP interfaces 116 associated with the WLAN 104 provides similar transmission functions between the mobile communication device 103, the wireless connector system 120 and network connection point, such as the messaging server 132, the content server 134, the application server 136, or any combination of these.

It will be appreciated that the above-described communication system 100 is provided for illustration purposes only. The above-described communication system 100 may be implemented using any of a multitude of network configurations for use with the mobile communication devices 103. Suitable variations of the communication system 100 will be readily appreciated by a person of ordinary skill in the art and are intended to fall within the scope of the present disclosure.

Figure 2:
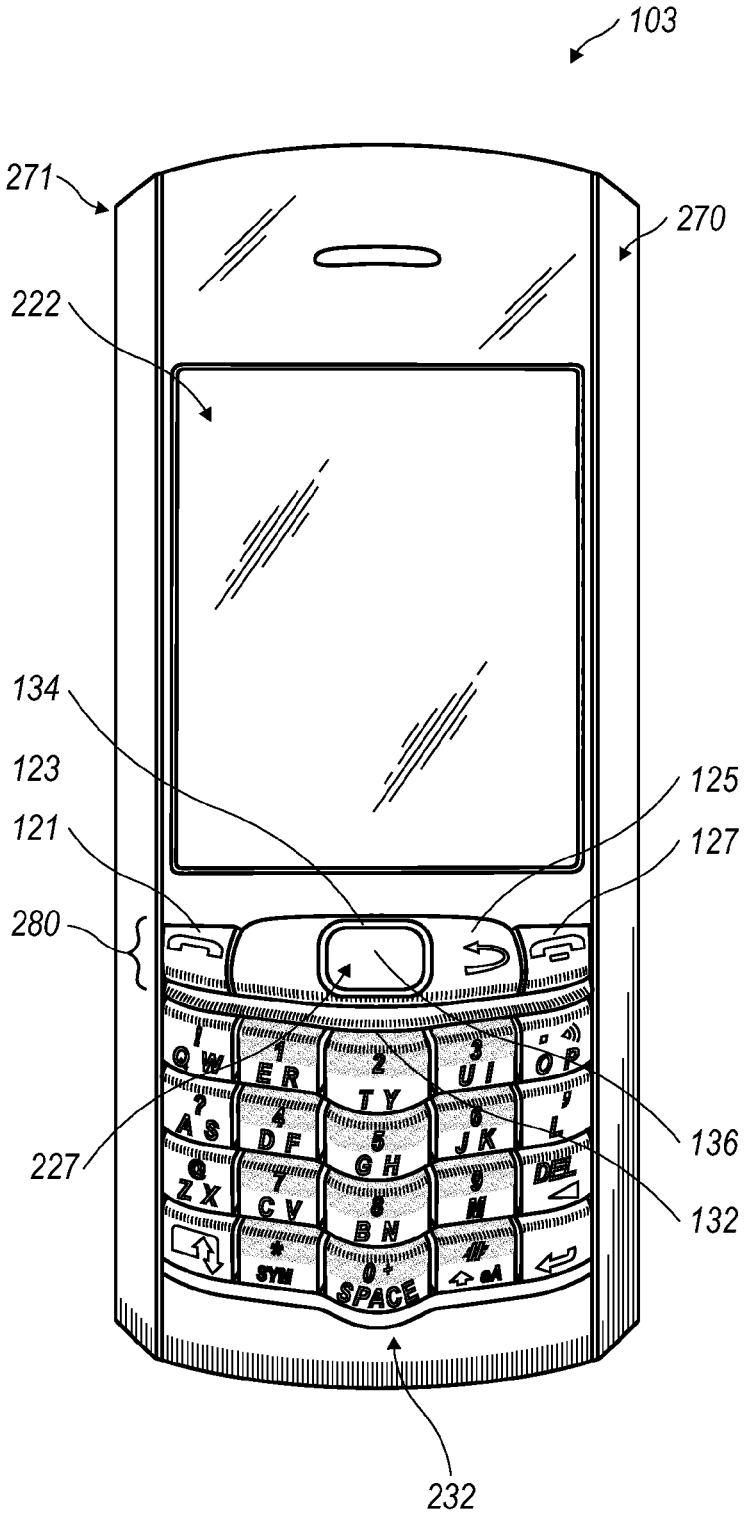
FIG. 2 is a mobile communication device according to one example.

FIG. 2 illustrates an example of a mobile communication device 103 having a display 222 positioned above a keyboard 232 or other suitable device for accommodating textual input to the mobile communication device 103. In accordance with an aspect of the disclosure, the mobile communication device 103 may include a front face 270 having a navigation row 280. As shown, the mobile communication device 103 may include a "uni-body" structure, also known to those skilled in the art as a "candy-bar" design.

The mobile communication device 103 may include an input device 227 that acts as a cursor navigation tool. The input device 227 may be exteriorly located upon the front face 270 of the mobile communication device 103. The location of input device 227 on the front face 270 allows the cursor navigation tool to be thumb-actuable, e.g., like the keys of the keyboard 232. Some examples provide the input device 227 in the form of an optical navigation tool that may be utilized to instruct two-dimensional screen cursor movement in substantially any direction. The input device 227 may act as an actuator when the cursor navigation tool is depressed like a button. Other examples may provide the input device 227 in the form of a track pad, a touchpad, a trackball, a pointing stick, a joystick, a graphics tablet, or the like. The input device 227 may be placed above the keyboard 232 and below the display 222. In this location, the input device 227 may avoid interference during data entry and does not block the operator's view of the display screen 222 during use.

The radio application allows users of the mobile communication device 103 to select among various over-the-air radio stations and perform actions on the radio station content, including recording content, naming a file that corresponds to recorded radio content, sharing information associated with the radio content, and purchasing items advertised through the radio content, or the like. The radio application presents a graphical user interface with information, such as a currently tuned radio station frequency, a radio station call sign, a radio station name, an artist name, a song title, a radio program type (e.g., news, talk, rock, etc.) and a broadcast time, or the like. The radio application graphical user interface includes icons for performing the actions on the radio station content. The mobile communication device 103 also may be configured to send and receive voice communications, such as mobile telephone calls, and may include a camera (not shown) to capture digital content, such as photographs.

Figure 3:
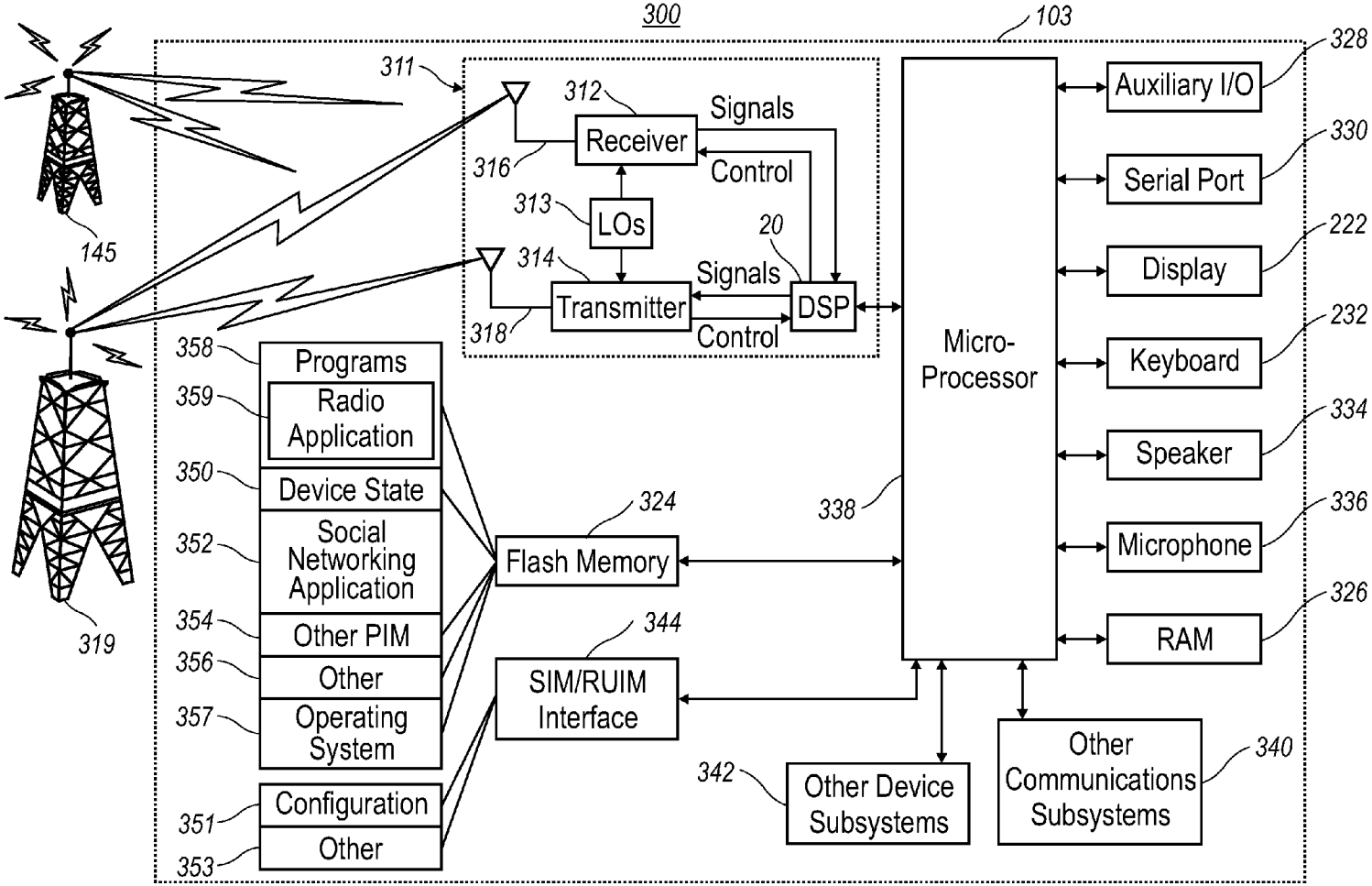
FIG. 3 is a block diagram of the mobile communication device illustrated in FIG. 2 operating in a communication environment according to one example.

FIG. 3 illustrates a block diagram 300 of the mobile communication device 103 in accordance with one example. The mobile communication device 103 includes a microprocessor 338 that controls operations of the mobile communication device 103. A communication subsystem 311 is provided to perform communications, including transmission and reception of analog data and digital data via the wireless digital communication network 319 and a wireless analog broadcast system 145. The communication subsystem 311 may support over-the-air radio broadcasts, such as analog FM and AM broadcasts, along with short range digital communication systems, such as a BLUETOOTH® communication module or a WI-FI™ communication module. The WI-FI™ communication module may comply with IEEE 802.11x, and associated circuits and components.

Alternatively, one of ordinary skill in the art will appreciate that the communication subsystem 311 may be implemented using more than one component. For example, the mobile communication device 103 may include other communication subsystems 340 and other device subsystems 342 to perform communication operations. The communication subsystem 340 receives the over-the-air radio broadcasts including analog FM and AM broadcasts, along with associated RDS data. The communication subsystem 340 converts the analog radio signals to digital signals and delivers the digital signals to the microprocessor 338. According to one example, the microprocessor 338 decodes the RDS data and generates identification tags based on the RDS data. The identification tags may include the currently tuned radio station frequency, the radio station call sign, the radio station name, the artist name, the song title, the radio program type (e.g., news, talk, rock, etc.), and the broadcast time, media player device information or the like. The identification tags may be generated automatically by the system or manually by the user.

According to one example, the microprocessor 338 performs compression/decompression ("CODEC") on the digital signals before storing or playing content on the mobile device 103. The CODEC operation reduces streaming data bits to enhance processing speeds and preserve resources on the mobile communication device 103, among providing other benefits. The CODEC operation is configured to provide minimal distortion in content quality of the data. For example, audio content may be processed using an MP3 CODEC. One of ordinary skill will readily appreciate that different CODECs may be used for different content types, including audio content and video content, among other content types. Furthermore, different CODECs may be used for different devices and file types.

Alternatively, the communication subsystem 340 may include a short range communication system, such as a BLUETOOTH® communication module or a WI-FI™ communication module, such as a communication module in compliance with IEEE 802.11b, and associated circuits and components. Additionally, the microprocessor 338 may be configured to perform operating system functions that enable execution of programs on the mobile communication device 103.

The microprocessor 338 is configured with operating system functionality to enable program execution on the mobile communication device 103. For example, the microprocessor 338 may be communicatively coupled to an auxiliary input/output (I/O) subsystem 328 and a serial port 330, such as a Universal Serial Bus port, which enables communications with other devices or systems. The display 222 may be communicatively coupled to the microprocessor 338 to display a GUI on the mobile communication device 103. When the mobile communication device 103 is equipped with a keyboard 232, the keyboard 232 also may be communicatively coupled with the microprocessor 338. The mobile communication device 103 may include a speaker 334, a microphone 336, a random access memory (RAM) 326, and a flash memory 324, among other components. These components may be communicatively coupled to the microprocessor 338. One of ordinary skill will appreciate that fewer components may be included in the mobile communication device 103. For example, the keyboard 232 may be a virtual keyboard that is integrated with a touch screen rather than being provided as a separate component.

The auxiliary I/O subsystem 328 may take the form of a variety of different navigation tools, including multi-directional or single-directional navigation tools. The navigation tools may include an optical navigation tool, a trackball navigation tool, a thumbwheel, a navigation pad, a joystick or a touch-sensitive interface, among other I/O interfaces. According to one example, the navigation tool may include the optical navigation tool 227 illustrated in FIG. 2. The navigation tool may be located on the front surface of the mobile communication device 103 or may be located on any exterior surface of the mobile communication device 103.

Other auxiliary I/O subsystems may include external display devices and externally connected keyboards (not shown). While the above examples have been provided in relation to the auxiliary I/O subsystem 328, other subsystems capable of providing input or receiving output from the mobile communication device 103 are considered within the scope of this disclosure. Additionally, other keys may be placed along the side of the mobile communication device 103 to function as escape keys, volume control keys, scrolling keys, power switches, or user programmable keys, and may likewise be programmed accordingly.

The keyboard 232 may include a plurality of keys that are physical in nature, such as actuable buttons. Alternatively, the keyboard 232 may be implemented as a virtual keyboard with software instructions provided to represent physical keys (referred to herein as "virtual keys") on the display 222. It is also contemplated that user input may be provided as a combination of these two types of keys. Each key of the plurality of keys may be associated with at least one action, which may be the input of a character, a command or a function, among other actions. In this context, "characters" are contemplated to include, for example, alphabetic letters, language symbols, numbers, punctuation, insignias, icons, pictures, or blank space, among other characters.

In the case of virtual keys, the indicia for the respective keys may be shown on the display screen 222. According to one example, the virtual keys may be selected by touching the display screen 222. A stylus, finger, or other pointer may be used to generate a desired character or activate an indicated command or function. Some examples of display screens 222 that are capable of detecting touch include resistive, capacitive, projected capacitive, infrared and surface acoustic wave (SAW) touch screens. Physical and virtual keys may be combined in many different ways, as appreciated by those skilled in the art.

The mobile communication device 103 may be equipped with components that enable operation of various programs. A flash memory 324 may be provided to store an operating system 357, device programs 358, and data. The device programs 358 may include the radio application 359, which is described further below. The operating system 357 is generally configured to manage the programs 358. The programs 358 may be stored in the flash memory 324 and may be executed on the microprocessor 338. The operating system 357 honors requests for services made by the programs 358 through predefined program interfaces, among other request types. More specifically, the operating system 357 typically determines the order in which the multiple programs 358 are executed on the microprocessor 338. The operating system 357 also determines an execution time allotted to each program 358, manages sharing of the flash memory 324 among the multiple programs, and handles input and output to and from other device subsystems 342, among performing other operations.

Additionally, operators may interact directly with the operating system 357 through the display 222. Interactions may be facilitated by input devices, including the keyboard 232, auxiliary input/output device 328, and the display screen 222. While an example of the operating system 357 may be stored in the flash memory 324, the operating system 357 in other examples may be stored in a read-only memory (ROM) or similar storage element (not shown). As those skilled in the art will appreciate, the operating system 357, device program 358 (or parts thereof) may be loaded in a RAM 326 or other volatile memory. The flash memory 324 may be configured to support communication between the radio application 359 and a plurality of programs, including social networking applications 352, a personal information manager (PIM) 354, and a device state 350, among other programs. Additionally, the flash memory 324 may be configured to segregate communication between the programs 358 and other information 356.

The mobile communication device 103 may be equipped with earphones that act as an antenna (not shown) to receive signals from the wireless analog broadcast system 145. Examples of wireless analog broadcast systems 145 that enable communication include FM broadcast systems 145 or AM broadcast systems.

Furthermore, the mobile communication device 103 may equipped for two-way communication within the wireless digital communication network 319. Digital signals may be sent and received from a mobile communication service. Examples of communication systems enabled for two-way communication include, but are not limited to, Long Term Evolution (LTE); General Packet Radio Service (GPRS) networks; Universal Mobile Telecommunication Service (UMTS) networks; Enhanced Data for Global Evolution (EDGE) networks; Code Division Multiple Access (CDMA) networks; High-Speed Packet Access (HSPA) networks; Universal Mobile Telecommunication Service Time Division Duplexing (UMTS-TDD) networks; Ultra Mobile Broadband (UMB) networks; Worldwide Interoperability for Microwave Access (WiMAX) networks, or other networks that can be used for combined data and voice capabilities or separate data and voice capabilities.

For the communication systems listed above, the mobile communication device 103 may use a unique identifier to enable the mobile communication device 103 to transmit and receive signals from the communication network 319. Other systems may not use such identifying information. For example, GPRS, UMTS, and EDGE use a Subscriber Identity Module (SIM) in order to allow communication with the communication network 319. Likewise, most CDMA systems use a Removable User Identity Module (RUIM) in order to communicate with the CDMA network. The RUIM and SIM card can be used in multiple different mobile communication devices 103. The mobile communication device 103 may be able to operate some features without a RUIM or SIM card, but may not be able to communicate with the network 319. A SIM/RUIM interface 344 may be located within the mobile communication device 103 to allow for removal or insertion of the RUIM and SIM card (not shown). The RUIM and SIM card may include a memory that holds key configurations 351 and other information 353, such as identification and subscriber-related information. With a properly enabled mobile communication device 103, two-way communication may be performed between the mobile communication device 103 and the communication network 319.

If the mobile communication device 103 is enabled as described above, or the digital communication network 319 includes such enablement, the two-way communication enabled mobile communication device 103 may be configured to both transmit and receive multi-media content and other data from the communication network 319. The communication transfer may be performed to or from the mobile communication device 103. In order to communicate with the communication network 319, the mobile communication device 103 may be equipped with an integral or internal antenna 318 that transmits signals to the communication network 319. Likewise, the mobile communication device 103 may be equipped with an additional antenna 316 for receiving communication from the communication network 319. According to one example, these antennae 316, 318 may be combined into a single antenna (not shown). As one skilled in the art will appreciate, the antenna or antennae 316, 318 may be externally mounted on the mobile communication device 103 in another example.

When equipped for two-way communication, the mobile communication device 103 may include the communication subsystem 311 that supports the operational needs of the mobile communication device 103. The communication subsystem 311 may include a transmitter 314 and a receiver 312 including an associated antenna or antennae 316, 318 as described above, local oscillators (LOs) 313, and a processing module that in the presently described example is a digital signal processor (DSP) 320.

It is contemplated that communication between the mobile communication device 103 and the wireless network 319 may be any type of communication that both the wireless network 319 and mobile communication device 103 are enabled to support. In general, these communications may be classified as voice and data communications. Voice communication generally refers to communication in which signals for audible sounds are transmitted through the communication network 319 by the mobile communication device 103. Data communication generally refers to all other types of communication that the mobile communication device 103 is capable of performing within the constraints of the wireless network 319.

FIGS. 1, 2 and 3 are examples only and those persons skilled in the art will appreciate that additional elements and modifications may be necessary to make the mobile communication device 103 operate in particular analog broadcast environments and digital network environments. The illustrated examples disclose the mobile communication devices 103 as smart phones. Alternative examples contemplate that the communication devices 103 may include personal digital assistants (PDA), tablet computers, laptop computers, or other communication devices capable of sending and receiving electronic messages. According to one example, the mobile communication devices 103 and the corresponding mobile communication device 300 structure may be characterized by an identification number that is assigned to the mobile communication device 103. According to one example, the identification numbers cannot be changed and are locked to each device.

The mobile communication devices 103 may include, or be modified to include, the radio application 359 to enable client-side selection, sharing, and recording of radio content using the mobile communication devices 103. Alternatively, the radio application 359 may reside on one or more servers 132, 134, 136 to enable server-side selection, sharing, and recording of radio content. Furthermore, the mobile communication device 103 includes social network applications that enable users to communicate with third parties. The radio application 359 operates concurrently with the social network application to enable sharing of radio station information, radio content information and RDS data, or the like, using the mobile communication devices 103. As discussed below, the radio content may be quickly stored, located, and retrieved using the RDS data and the device information, for example. Furthermore, radio content information may be shared in substantially real-time using social network applications.

While receiving over-the-air radio broadcasts on the mobile communication device 103, users may manipulate the radio application 359 to perform actions, including storing, locating, retrieving, and rewinding the radio content. For example, the radio application 359 allows users to efficiently perform actions, such as generating or identifiers for the radio content tags based on RDS data that accompanies radio broadcasts and device information. Users may navigate within the radio application 359 by manipulating an input device include at least one of the keyboard, the navigation tool, the voice-command receiving tool, or the like. For example, the user may manipulate the input device to position a cursor or other pointer at a desired location or icon on the display.

According to one example, the user actuates a user-selected key on the keyboard or an icon on the display 222 to begin recording desired radio content. The radio application 359 creates a file name to identify the recorded radio content. For example, the radio application 359 may automatically create a file name that includes a program service, a station call sign, an FM frequency, a year, a month, a day, or a time of recording the desired radio content. The radio application 359 further allows users to define file names based on information available to the radio application 359.

Radio content and other data may be stored within the files and may be further identified using data tags or metadata. For example, files saved using an MP3 format may employ data tags or metadata embedded within tracks of the storage medium to provide an index of the radio content. The radio application 359 reads the embedded data tags or metadata and displays a corresponding data structure on the display 222. The radio application 359 employs the data tags to index, organize and display the radio content. The radio application 359 also may use the data tags to search files that are stored using the mobile communication device 103.

The data tags or metadata also may include information extracted from the captured radio content. For example, the data tags may include: a date and a time that the radio content was captured; a frequency of the radio station that broadcast the radio content; and the type of mobile communication device 103 that captured, or the like. Additionally, the data tags or metadata may include information received through the RDS data stream broadcast concurrently with the radio content including: a program type (e.g., rock, news, etc.); a radio text or custom field used for track name; and a program service such as station call letters; or the like.

According to one example, the radio application 359 creates the data tags by mapping information into the data tag, such as an MP3 tag. For example, the radio application 359 may map: <RDS radio text (64 character description> into a title tag field; <RDS program service (station call type) and FM receive frequency> into an artist tag field; <RDS program type (pre-defined broadcast type)> into a genre tag field; <Mobile device clock year> into a year tag field; <Mobile device record date and time (YY/MM/DD HH:MM:SS format)> into a comment tag field; <FM radio content> into an album field; and <Graphical image logo> into an embedded image field. The radio application 359 further allows users to define data tag formats based on information available to the radio application 359.

As discussed above, upon initiating the recording operation, the radio application 359 creates a file name that identifies the radio content and generates data tags that enable further indexing of the radio content. In response to the recording operation, the radio application 359 continues recording the desired radio content to the memory buffer so that the desired radio content trails the pre-determined length of pre-recorded radio content. In this way, the pre-determined length of pre-recorded radio content compensates for user delay or latency in recognizing the desired radio content and selecting the record icon. The delay may be introduced by users navigating menus to initiate the recording operation, or the like. Alternatively, the user may decide to initiate the recording operation several seconds after the start of the desire radio content. The user may adjust the length of pre-recorded radio content that is added to the beginning of the user-initiated recording operation. For example, the user may elect to have all, none or some of the pre-determined length of pre-recorded radio content added to the beginning of the recording operation. Alternatively or additionally, the radio application may be configured to allow users to rewind or replay the pre-determined amount of the over-the-air content to capture missed information, such as a telephone number, address, or other missed information.

The radio application 359 may be configured to monitor RDS data associated with the received over-the-air content. The radio application 359 may automatically perform preselected actions in response to monitoring the RDS data. For example, the radio application 359 may automatically prepare and send alerts using communication applications, including instant message applications, email applications, or the like. According to one example, the radio application 359 may monitor the RDS data and send alerts when the RDS data includes preselected titles, artists, songs or the like. One of ordinary skill in the art will appreciate that the radio application 359 may be configured to perform other preselected actions.

According to another example, the radio application 359 may automatically record over-the-air radio content when the RDS data includes preselected titles, artists, songs or the like. Alternatively, the radio application 359 may present a pre-defined GUI when the RDS data includes preselected information. For example, the pre-defined GUI may prompt users to actuate an input device in order to record over-the-air radio content, such as selecting a GUI icon or selecting one or more keys on the keyboard of the mobile communication device 103.

As discussed above, the radio application 359 provides automatic file name creation and manual file name creation for radio content using the mobile communication device 103. The radio content may be subsequently retrieved and configured for display on the display 222 of the mobile communication device 103.

The radio application 359 may include functionality for rewinding or replaying buffered radio content. For example, users may rewind the buffered radio content to overcome delays introduced between receiving an alert of currently playing desired radio content and configuring the radio application 359 to play the desired radio content. In another example, users may wish to replay a few seconds of buffered over-the-air broadcast rather than store the currently playing content to an audio file. For example, a user may desire to rehear a telephone number or an address provided in an advertisement, rather than store the advertisement.

The radio application 359 may provide rewinding or replaying functionality through a menu or icon on the display 222. For example, the radio application 359 may present a rewind button on the display 222 that performs the rewind function while selected. Alternatively, the radio application 359 may provide rewinding or replaying functionality through a key on the keyboard. For example, the radio application 359 may respond to an input signal provided from a pre-selected key on the keyboard to perform the rewind function while depressed. Additionally, the radio application 359 may be configured to allow the user to select time increments associated with actuation of the record icon or rewind button. Still further, the radio application 359 may include menu options for allowing users to assign a time increment for each actuation of the rewind button.

Figure 4:
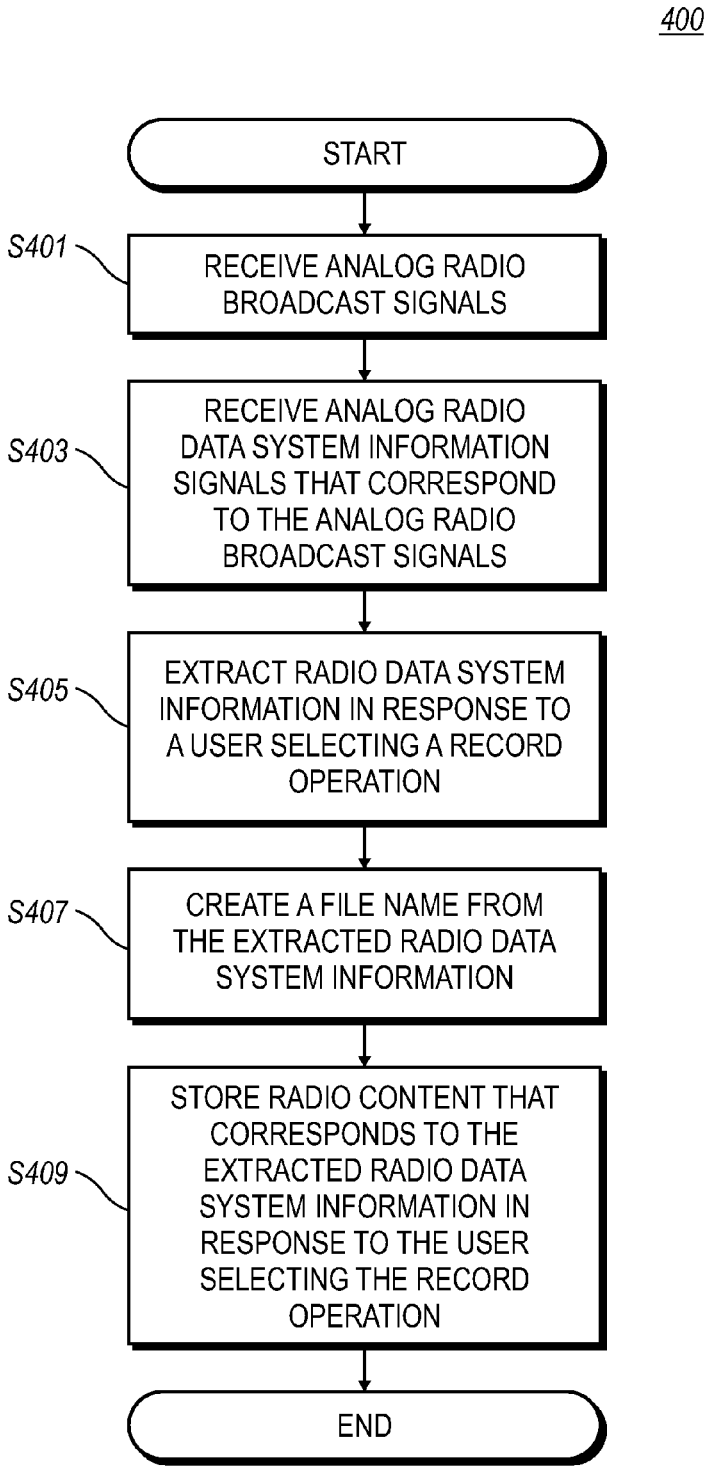
FIG. 4 is a flow chart illustrating a process of recording a radio broadcast received in an analog format on a mobile communication device according to one example.

FIG. 4 illustrates an example process diagram for performing a method 400 of recording a radio broadcast received in an analog format using a mobile communication device 103. The mobile communication device 103 receives analog radio broadcast signals in step S401 and concurrently receives analog radio data system information signals that correspond to the analog radio broadcast signals in step S403. The radio application 359 extracts radio data system information in response to a user selecting a record operation in step S405 and creates a file name from the extracted radio data system information in step S407. The radio application 359 further stores radio content that corresponds to the extracted radio data system information in response to the user selecting the record operation in step S409.

The method 400 may further include monitoring the radio data system information for pre-defined criteria and sending alerts to the user upon detecting the pre-defined criteria. The pre-defined criteria may include at least one of a preselected title, artist, and song. The method 400 may further include rewinding the stored radio content by a pre-determined amount in response to the user selecting the record operation. Additionally, the method 400 may further include appending buffered radio content to a beginning of the stored radio content in response to the user selecting the record operation.

According to one example, the radio application 359 may be a client application that resides on the mobile communication device 103 and is executable on the microprocessor 338. The radio application 359 may record a radio broadcast received in an analog format, among performing other actions. Alternatively, the disclosure may include a client application that communicates with a remote server application to enable processing the data at the remote server.

The disclosure may be implemented using hardware or software in association with hardware. In some examples, the software may include firmware, resident software, microcode, a Field Programmable Gate Array (FPGA) or Application-Specific Integrated Circuit (ASIC), etc. In particular, for real-time or near real-time use, an FPGA or ASIC implementation is desirable.

Furthermore, the disclosure may take the form of a computer program product that includes program modules accessible from computer-usable or computer-readable medium storing program code for use by or in connection with one or more computers, processors, or instruction execution system. The medium can be an electronic, magnetic, optical, electromagnetic, infrared, or semiconductor system (or apparatus or device) or a propagation medium (though propagation mediums in and of themselves as signal carriers are not included in the definition of physical non-transitory computer-readable medium). Examples of a physical non-transitory computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD. Both processors and program code for implementing each as aspect of the technology can be centralized or distributed (or a combination thereof) as known to those skilled in the art.

A data processing system suitable for storing a computer program product of the technology and for executing the program code of the computer program product will include at least one processor coupled directly or indirectly to memory elements through a system bus. The memory elements can include local memory employed during actual execution of the program code, bulk storage, and cache memories that provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers. Network adapters can also be coupled to the system to enable the data processing system to become coupled to other data processing systems or remote printers or storage devices through intervening private or public networks. Modems, cable modem and Ethernet cards are just a few of the currently available types of network adapters. Such systems can be centralized or distributed, e.g., in peer-to-peer and client/server configurations. In some examples, the data processing system is implemented using one or both of FPGAs and ASICs.

I claim:

1. A computer-implemented method of recording a radio broadcast received in an analog format at a mobile communication device, the method comprising:

receiving analog radio broadcast signals and analog radio data system information signals that correspond to the analog radio broadcast signals; and in response to a user selecting a record operation:

extracting radio data system information from the analog radio data system information signals;

creating a file name from the radio data system information;

storing radio content, from the analog radio broadcast signals, that corresponds to the radio data system information; and sharing at least part of the radio data system information with a second communication device.

2. The computer-implemented method of claim 1, further comprising:

monitoring the radio data system information for pre-defined criteria; and sending alerts to the user upon detecting the pre-defined criteria.

3. The computer-implemented method of claim 2, wherein the pre-defined criteria includes at least one of a preselected title, artist, and song.

4. The computer-implemented method of claim 1, wherein extracting the radio data system information is performed in response to receiving one of: a first actuation signal from a user-selected key on a keyboard of the mobile communication device or a second actuation signal from a user-selected icon on the graphical user interface of the mobile communication device.

5. The computer-implemented method of claim 4, wherein the radio data system information includes at least one of a program type, a station call sign, a station frequency, a song title, an artist name, a genre, an album, a year, a month, a day, and a time of recording the radio content.

6. The computer-implemented method of claim 1, further comprising rewinding the stored radio content by a pre-determined amount in response to the user selecting the record operation.

7. The computer-implemented method of claim 1, further comprising appending buffered radio content to a beginning of the stored radio content in response to the user selecting the record operation.

8. A computer program product provided on a computer readable medium for recording a radio broadcast received in an analog format at a mobile communication device and converted to a digital format, the computer program product comprising computer instructions which, upon execution by a processor of the mobile communication device, cause the processor to:

receive radio broadcast signals and radio data system information signals that correspond to the radio broadcast signals; and in response to a user selecting a record operation:

extract radio data system information from the radio data system information signals;

create a file name from the radio data system information;

store radio content, from the radio broadcast signals, that corresponds to the radio data system information; and share at least part of the radio data system information with a second communication device.

9. The computer program product of claim 8, wherein the computer program product comprises computer instructions which, upon execution by a processor of the mobile communication device, cause the processor to:

monitor the radio data system information for pre-defined criteria; and send alerts to the user upon detecting the pre-defined criteria.

10. The computer program product of claim 9, wherein the pre-defined criteria includes at least one of a preselected title, artist, and song.

11. The computer program product of claim 8, wherein the processor is further programmed to extract the radio data system information in response to receiving one of: a first actuation signal from a user-selected key on a keyboard of the mobile communication device or a second actuation signal from a user-selected icon on the graphical user interface of the mobile communication device.

12. The computer program product of claim 11, wherein the radio data system information includes at least one of a program type, a station call sign, a station frequency, a song title, an artist name, a genre, an album, a year, a month, a day, and a time of recording the radio content.

13. The computer program product of claim 8, wherein the processor is further programmed to rewind the stored radio content by a pre-determined amount in response to the user selecting the record operation.

14. The computer program product of claim 8, wherein the processor is further programmed to append buffered radio content to a beginning of the stored radio content in response to the user selecting the record operation.

15. A mobile communication device for recording a radio broadcast received in an analog format at the mobile communication device, the mobile communication device comprising:

a processor programmed to:

receive radio broadcast signals and radio data system information signals that correspond to the radio broadcast signals; and in response to a user selecting a record operation:

extract radio data system information from the radio data system information signals;

create a file name from the extracted radio data system information;

store radio content, from the analog radio broadcast signals, that corresponds to the radio data system information; and share at least part of the radio data system information with a second communication device.

16. The mobile communication device of claim 15, wherein the processor is further programmed to:

monitor the radio data system information for pre-defined criteria; and send alerts to the user upon detecting the pre-defined criteria.

17. The mobile communication device of claim 16, wherein the pre-defined criteria includes at least one of a preselected title, artist, and song.

18. The mobile communication device of claim 15, wherein the processor is further programmed to extract the radio data system information in response to receiving one of: a first actuation signal from a user-selected key on a keyboard of the mobile communication device or a second actuation signal from a user-selected icon on the graphical user interface of the mobile communication device.

19. The mobile communication device of claim 18, wherein the radio data system information includes at least one of a program type, a station call sign, a station frequency, a song title, an artist name, a genre, an album, a year, a month, a day, and a time of recording the radio content.

20. The mobile communication device of claim 15, wherein the processor is further programmed to rewind the stored radio content by a pre-determined amount in response to the user selecting the record operation.

* * * * *